US008417176B2

(12) United States Patent
Shoji et al.

(10) Patent No.: US 8,417,176 B2
(45) Date of Patent: Apr. 9, 2013

(54) IMAGE FORMING APPARATUS

(75) Inventors: Yutaka Shoji, Tokyo (JP); Junji Shirakawa, Tokyo (JP); Takayuki Muneyasu, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 938 days.

(21) Appl. No.: 12/222,434

(22) Filed: Aug. 8, 2008

(65) Prior Publication Data

US 2009/0052965 A1 Feb. 26, 2009

(30) Foreign Application Priority Data

Aug. 23, 2007 (JP) ..... 2007-217207

(51) Int. Cl.
*G03G 15/00* (2006.01)

(52) U.S. Cl.
USPC ..... 399/401; 399/21; 399/402; 399/405; 271/184; 271/185; 271/186; 271/278; 271/291; 271/301; 271/302; 271/303

(58) Field of Classification Search ..... 399/21, 399/401, 402, 405; 271/184, 185, 186, 278, 271/291, 301, 302, 303
See application file for complete search history.

(56) References Cited

U.S. PATENT DOCUMENTS

| | | | | |
|---|---|---|---|---|
| 6,226,473 | B1 | 5/2001 | Kutsuwada | |
| 2005/0063747 | A1 * | 3/2005 | Ushio | 399/406 |
| 2007/0196121 | A1 * | 8/2007 | Ohnishi | 399/79 |
| 2007/0296135 | A1 * | 12/2007 | Takahagi et al. | 271/10.01 |
| 2008/0056761 | A1 | 3/2008 | Kawahara et al. | |

FOREIGN PATENT DOCUMENTS

| | | | |
|---|---|---|---|
| JP | 56-007869 | | 1/1981 |
| JP | 62-18464 | | 1/1987 |
| JP | 02-248968 | | 10/1990 |
| JP | 06-40600 | | 2/1994 |
| JP | 06-156805 | | 6/1994 |
| JP | 07-228388 | | 8/1995 |
| JP | 09-124208 | | 5/1997 |
| JP | 09124208 | A * | 5/1997 |
| JP | 11-246060 | | 9/1999 |
| JP | 2003-95508 | | 4/2003 |
| JP | 2003-263076 | | 9/2003 |
| JP | 2006-096502 | | 4/2006 |

OTHER PUBLICATIONS

Office Action dated Nov. 1, 2011 for corresponding Japanese Patent Application No. 2007-327186.

* cited by examiner

*Primary Examiner* — Matthew G Marini
*Assistant Examiner* — Andy Pham
(74) *Attorney, Agent, or Firm* — Harness, Dickey & Pierce, P.L.C.

(57) ABSTRACT

A disclosed image forming apparatus includes a main conveyance path configured to convey a recording medium from a paper feeding unit to a sheet discharge unit; a double-side reversing conveyance path configured to switch back a recording medium, one side of which has an image formed, so as to reverse the sides of the recording medium for double-sided image formation; a sheet resending conveyance path configured to resend the recording medium reversed in the double-side reversing conveyance path to the main conveyance path; and a double-side reversing open-space unit configured to provide a space for switching back the recording medium on the double-side reversing conveyance path. The double-side reversing open-space unit also serves as a temporary tray for storing misfed recording media and remaining recording media left inside the image forming apparatus when a jam occurs.

10 Claims, 4 Drawing Sheets

IMAGE FORMING APPARATUS

BACKGROUND OF THE INVENTION

1. Field of the Invention

The present invention relates to an image forming apparatus, such as a printing machine, a copying machine, a fax machine or a printer, and more particularly to conveyance of recording media in such an image forming apparatus.

2. Description of the Related Art

As to image forming apparatuses, such as printing machines and copying machines, demand has been raised for high-speed and large-volume printing or duplicating/printing in recent years. To meet such a need, for example, a high-capacity paper feeding unit is required to be provided inside the main body of such an image forming apparatus, or a paper feeding table needs to be attached to a lower part of the main body. As a consequence, the whole size of the apparatus—that is, the total height and width of the apparatus—tends to become large.

In the case of an electrophotographic image forming apparatus, the apparatus includes a toner fixing device for fixing unfixed toner on a recording medium. If this image forming apparatus is a high-speed one as described above, toner needs to be fixed on a great number of recording media per unit time, which necessitates the toner fixing means having increased heat capacity in order to prevent fixation failure. Accordingly, the toner fixing device itself becomes large in size due to being equipped with a large-diameter fixing roller, which in turn leads to an increase in size of the image forming apparatus. In addition, large-capacity toner bottles need to be housed inside the apparatus, and thus especially in the case of a full-color image forming apparatus where three or four color toner bottles are necessary, the total height and width of the image forming apparatus can only increase further due to those toner bottles.

With the increase in size of image forming apparatuses, a problem related to jamming has been further exacerbated. Namely, once jamming of paper or the like occurs in a large-sized image forming apparatus, it is sometimes the case that recording media other than the recording medium having caused the jamming also remain inside the image forming apparatus. In jam processing for eliminating the jamming, it is necessary to remove recording media left at various different locations inside the apparatus, thus requiring a lot of time for the jam processing. As the image forming apparatuses make progress toward higher speed and larger capacity, a larger number of recording media tend to be left inside the apparatuses when jamming occurs. Accordingly, the time required for jam processing severely impairs the image forming productivity of the apparatuses.

Patent Document 1 discloses an image forming apparatus in which, even when multiple sheet misfeeds occur—namely, two or more sheets are delivered stacked one on top of another, an image forming operation is performed by feeding sheets smoothly without stopping the conveyance. Here, by switching the sheet conveyance path, sheets causing the conveyance failure are sent to a sheet holding unit which is a tray inside the apparatus dedicated to such misfed sheets. However, according to the invention of Patent Document 1, the sheet holding unit dedicated to misfed sheets needs to be provided inside the image forming apparatus, thus leading to the problem of the main body of the image forming apparatus further increasing in size.

Patent Document 2 discloses a technology aiming at facilitating jam processing performed when a sheet jam has occurred in a collation apparatus, which is a post-processing apparatus of an image forming apparatus. Here, without stopping the operation of discharging sheets from a sheet processing unit, subsequent sheets after the occurrence of the sheet jam are discharged to a temporary tray provided in a sheet reverse discharge apparatus on an extension of the sheet reverse discharge path. However, according to the image forming apparatus disclosed in Patent Document 2, it is necessary to dispose a reverse discharging unit having the temporary tray in front of the post-processing apparatus, thus not allowing the image forming apparatus alone to have the temporary tray function. Accordingly, the disclosed image forming apparatus has to be structured as a so-called image forming system, which leads to problems of a very large installation area and cost increase.

Patent Document 3 discloses an image forming apparatus in which an image forming operation is continuously performed even when a conveyance failure, such as multiple sheet misfeeds, has occurred. Here, by switching the sheet conveyance path, misfed sheets are discharged to a misfed-sheet discharge tray provided outside the apparatus. However, since another tray is required to be provided outside the apparatus, the image forming apparatus of Patent Document 3 has a large breadth, thus resulting in the problem of a large installation area.

Patent Document 4 discloses a technology in which, when jamming occurs in a post-processing apparatus of an input apparatus, such as an image forming apparatus, subsequent sheets after the occurrence of the sheet jam are discharged to a temporary tray by switching the sheet conveyance path. In the image forming apparatus disclosed in Patent Document 4, the temporary tray is provided on the post-processing apparatus, as in the case of the image forming apparatus of Patent Document 2. Thus, the post-processing apparatus connected to the image forming apparatus is necessary, which leads to problems such as a large installation area and cost increase.

In sum, the inventions suggested in Patent Documents 1-4 improve the operability during error recovery processing and the productivity by providing a tray dedicated to sheets of conveyance failures inside or outside of the image forming apparatus, or inside or outside of the post-processing apparatus. However, as has been described, the whole image forming apparatus or system increases in size because of the dedicated tray, thus leaving the problems of a large installation area and cost increase.

Patent Document 1: Japanese Laid-open Patent Application Publication No. 2003-263076

Patent Document 2: Japanese Laid-open Patent Application Publication No. H09-124208

Patent Document 3: Japanese Laid-open Patent Application Publication No. 2006-96502

Patent Document 4: Japanese Examined Patent Application Publication No. S62-18464

SUMMARY OF THE INVENTION

In view of the above problems, the present invention aims at providing an image forming apparatus that minimizes the installation area as much as possible while achieving both excellent operability and high performance.

The above-mentioned problems can be solved according to one embodiment of the present invention by providing an image forming apparatus that includes a main conveyance path configured to convey a recording medium from a paper feeding unit to a sheet discharge unit; a double-side reversing conveyance path configured to switch back a recording medium, one side of which has an image formed, so as to reverse the sides of the recording medium for double-sided image formation; a sheet resending conveyance path configured to resend the recording medium reversed in the double-side reversing conveyance path to the main conveyance path; and a double-side reversing open-space unit configured to provide a space for switching back the recording medium on the double-side reversing conveyance path. The double-side reversing open-space unit also serves as a temporary tray for storing misfed recording media and remaining recording media left inside the image forming apparatus when a jam occurs. Note that the term "double-side reversing" herein referred to means switching back a recording medium inside the image forming apparatus and thereby reversing the sides of the recording medium in order to form an image on the opposite side of the recording medium from the side on which an image has already been formed.

Furthermore, the aforementioned image forming apparatus may be arranged to further include a reverse discharge conveyance path configured to switch back a recording medium, one side of which has an image formed thereon, so as to reverse sides of the recording medium and thereby reverse discharge the recording medium; a reverse discharge open-space unit configured to provide a space for switching back the recording medium on the reverse discharge conveyance path; and a branching unit configured to switch the conveyance path of a recording medium between the sheet reverse discharge conveyance path and the double-side reversing conveyance path. The reverse discharge open-space unit and the double-side reversing open-space unit are disposed one adjacent to the other to together form a common-open unit, which also serves as the temporary tray. Note that the term "reverse discharge" herein referred to means so-called face-down discharge, in which the recording medium is discharged with its surface having an image formed thereon facing downward. The reverse discharge is employed to arrange recording media in a page sequence or a reading order when the recording media are continuously discharged.

DETAILED DESCRIPTION OF THE PREFERRED EMBODIMENTS

Next are described preferred embodiments of the present invention in reference to the drawings.

Figure 1:
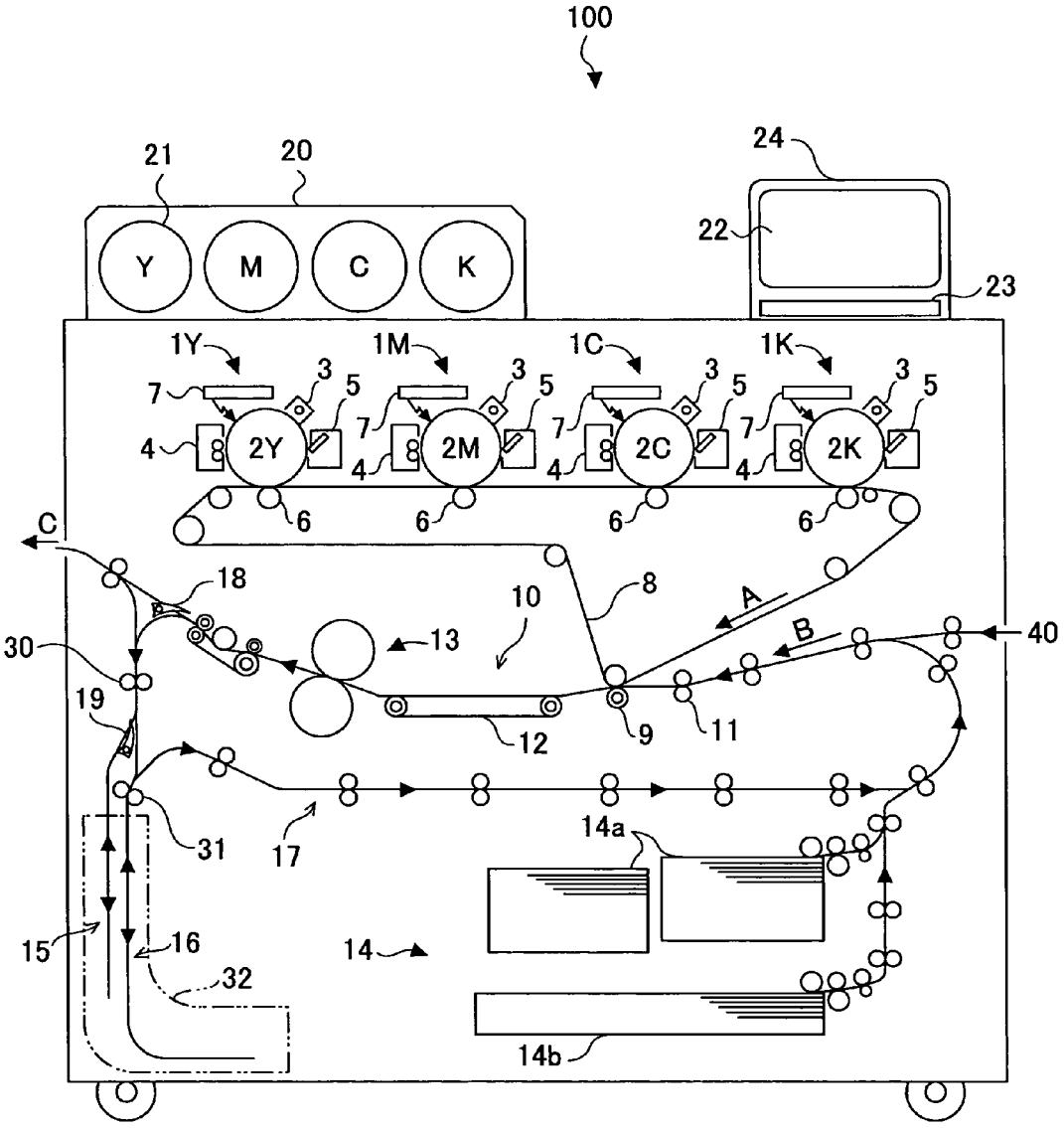
FIG. 1 is a schematic diagram illustrating an internal structure of a printing apparatus shown as an embodiment of the present invention.

FIG. 1 shows a printing apparatus 100 that is an image forming apparatus to which the present invention is applied. The printing apparatus 100 is a full color printer using four color toners of yellow (Y), cyan (C), magenta (M) and black (K). As shown in FIG. 1, four image forming units 1Y, 1M, 1C and 1K, each of which forms an image of a corresponding color toner, are provided side by side at the top inside of the image forming apparatus body. An intermediate transfer belt 8 passed over multiple supporting rollers is disposed below the four image forming units 1Y, 1M, 1C and 1K. The intermediate transfer belt 8 is driven to travel in a direction of arrow A by one of the supporting rollers being driven to rotate by drive means (not shown in the figure). Transfer rollers 6 functioning as primary transfer means are disposed so as to oppose the photosensitive drums 2 of the corresponding image forming units 1Y-1K, holding the intermediate transfer belt 8 therebetween. A toner bottle set unit 20 is provided on the top face of the printing apparatus 100 body. In the toner bottle set unit 20 are toner bottles 21, each of which contains a color toner to be supplied to a developing device 4 of the corresponding image forming unit 1. An operations unit 24 including a display unit 22 and an operations panel 23 is also provided on the top face of the printing apparatus 100 body. In addition, a recording medium conveyance unit 40 for receiving recording media from a high-volume sheet feeding apparatus (not shown) is provided on the right-hand side of the printing apparatus 100 in FIG. 1.

Respective image forming units 1Y, 1M, 1C and 1K have substantially the same structure and operation, and therefore, an overview of a single image forming unit 1 is described below without reference to colors (Y, M, C and K). As for the structure, a charging device 3, a developing device 4, a cleaning device 5 and the like are disposed around the photosensitive drum 2 that functions as an image carrier. Also, an exposing unit 7 is disposed on the upper side of the photosensitive drum 2. As for the operation, the photosensitive drum 2 is driven to rotate in a counterclockwise direction in FIG. 1, and the surface of the photoreceptor is charged with the same predetermined electrical polarity by the charging device 3. Then, a light-modulated laser beam emitted from the exposing unit 7 is projected onto the charging surface, whereby an electrostatic latent image is formed on the photosensitive drum 2. The electrostatic latent image is developed by toner applied by the developing device 4, and thus made to be visible as a toner image. Toner images of colors—yellow, cyan, magenta and black—formed by corresponding image forming units 1 are sequentially superposed one on top of the other and then transferred to the intermediate transfer belt 8.

On the other hand, a sheet feeding unit 14 including sheet trays 14*a* and 14*b* are provided at the lower part of the printing apparatus 100 body, and transfer paper, for example, is fed as recording media from the sheet feeding unit 14. In the case where neither a sheet reverse discharge process nor a double-sided image forming process is performed, the transfer paper is carried only in a main conveyance path 10, which serves to convey the recording media from the sheet feeding unit 14 to a sheet discharge unit. The main conveyance path 10 of the present embodiment refers to a conveyance path guiding the recording media, as shown by arrow C, from the sheet feeding unit 14 through registration rollers 11, a conveyance belt 12 and a toner fixing device 13 (all to be described below) and then through the upper side of a branching unit 18 to a sheet discharge unit provided outside the printing apparatus 100.

A recording medium fed from the sheet feeding unit 14 is carried toward the registration rollers 11, as shown by arrow B. After hitting the registration rollers 11 to stop temporarily, the recording medium is sent out by the registration rollers 11 at a timing to synchronize the recording medium with the toner image on the intermediate transfer belt 8. The recording medium is then sent to a secondary transfer unit at which a secondary transfer roller 9 comes in contact with the intermediate transfer belt 8. A voltage having the opposite polarity to the charge polarity of the toner is applied to the secondary transfer roller 9, whereby the superposed toner image (full color image) on the intermediate transfer belt 8 is transferred to the recording medium. The recording medium after the toner image is transferred thereto is carried to the toner fixing device 13 by the conveyance belt 12, and the toner is fixed on the recording medium with heat and pressure by the toner fixing device 13. In the case where neither a sheet reverse discharge process nor a double-sided image forming process is performed, the recording medium with the fixed toner image is conveyed by the branching unit 18 so as to pass over the upper side of the branching unit 18. Subsequently, the recording medium is discharged to the outside of the printing apparatus 100, as shown by arrow C, to be then sent to a sheet discharge tray or a post-processing apparatus (not shown).

As for the image forming apparatus of the present embodiment, in the case of performing a sheet reverse discharge process (face-down discharge) in single-sided printing, the recording medium conveyed from the toner fixing device 13 is first sent by the branching unit 18 to a reverse discharge conveyance path, passing through the lower side of the branching unit 18 in FIG. 1. The recording medium is then conveyed to a reverse discharge open-space unit 15 by a branching unit 19. Subsequently, the recording medium is switched back in the reverse discharge open-space unit 15 and discharged from the printing apparatus 100, as shown by arrow C, via the branching unit 19 and reverse discharge rollers 30. In this manner, the sheet discharged from the image forming apparatus is in a face-down orientation (face-down discharge). Note here that the reverse discharge conveyance path of the present embodiment refers to a conveyance path first branched off from the main conveyance path 10 by the branching unit 18, then passing through a point guided by the branching unit 19 toward the reverse discharge open-space unit 15 where the recording medium is switched back, and finally returning to the main conveyance path 10.

In the case of a double-sided image forming process, as in the case of the sheet reverse discharge process, a recording medium conveyed from the toner fixing device 13 is first sent by the branching unit 18 to the reverse discharge conveyance path, passing through the lower side of the branching unit 18 in FIG. 1. However, the recording medium deflected by the branching unit 18 is then sent by the branching unit 19 to a double-side reversing conveyance path, and switched back in a double-side reversing open-space unit 16 provided in the double-side reversing conveyance path to thereby reverse the up and down orientations of the recording medium. Subsequently, the recording medium passes through a sheet resending conveyance path 17 via double-side reversing rollers 31, then returns to the main conveyance path 10, and is sent back to the registration rollers 11 again. As for the recording medium returned to the main conveyance path 10, a toner image is transferred from the intermediate transfer belt 8 to the side of the recording medium opposite from the side on which an image has already been formed. The recording medium with the transferred toner image is again sent to the toner fixing device 13 to fix the toner image onto the recording medium. Subsequently, the recording medium is discharged to the outside of the printing apparatus 100, as shown by arrow C, either from the toner fixing device 13 as in the case of single-sided printing or after passing through the reverse discharge conveyance path to reverse the up and down orientations of the recording medium again. The discharged recording medium is consequently sent to a sheet discharge tray or a post-processing apparatus (not shown).

At the lower left side of FIG. 1, a common open-space unit 32 which is a main component of the present embodiment is indicated by a chain double-dashed line. As shown in FIG. 1, according to the embodiment of the present invention, the branching unit 19 is provided to switch the conveyance path from the reverse discharge conveyance path to the double-side reversing conveyance path, and the reverse discharge open-space unit 15 required for switchback in the sheet reverse discharge process is disposed adjacent to the double-side reversing open-space unit 16 required for switchback in the double-side reversing operation to together form the common open-space unit 32. Furthermore, the common open-space unit 32 also serves as a temporary tray for remaining recording media 35 left inside the printing apparatus 100 when jamming or another type of conveyance failure has occurred. Herewith, the printing apparatus 100 of the embodiment of the present invention allows its size to be decreased, compared to an image forming apparatus having a reverse discharge conveyance path and a double-side reversing conveyance path individually established in addition to a temporary tray dedicated to collecting remaining recording media or the like. Furthermore, the printing apparatus 100 of the embodiment of the present invention prevents cost increases due to an increase in the number of parts required, and also facilitates and simplifies the recovery operation for jamming. Thus, the present invention realizes an image forming apparatus which requires a minimum installation area while improving its operational productivity due to shortening of the time required for the jam recovery operation.

The present embodiment shown in FIG. 1 depicts that the reverse discharge conveyance path, double-side reversing conveyance path, branching unit 19 and common open-space unit 32 are arranged in the vertical direction. This arrangement further prevents the expansion of the width of the image forming apparatus. Note that the vertical direction referred to in the present embodiment means not only 90° in a mathematical sense—i.e. each of those components is disposed completely perpendicular to the horizontal direction, but also a roughly perpendicular direction, and thus includes some degree of misalignment and deviation.

Furthermore, in the present embodiment, the common open-space unit 32 is formed in the general shape of an L. This arrangement allows reducing the size of the common open-space unit 32 both in the vertical and horizontal directions, leading to a further reduction in size of the image forming apparatus. A guide member 33 is disposed in the common open-space unit 32, having a large curvature following the L-shaped configuration of the common open-space unit 32 (refer to FIGS. 2-4). The guide member 33 is provided to appropriately guide, along the L-shaped configuration of the common open-space unit 32, a recording medium to be switched back in the sheet reverse discharge process or double-side reversing process as well as the remaining recording media 35 (including a misfed recording medium causing a jam) conveyed to the common open-space unit 32 when jamming has occurred.

Figure 2:
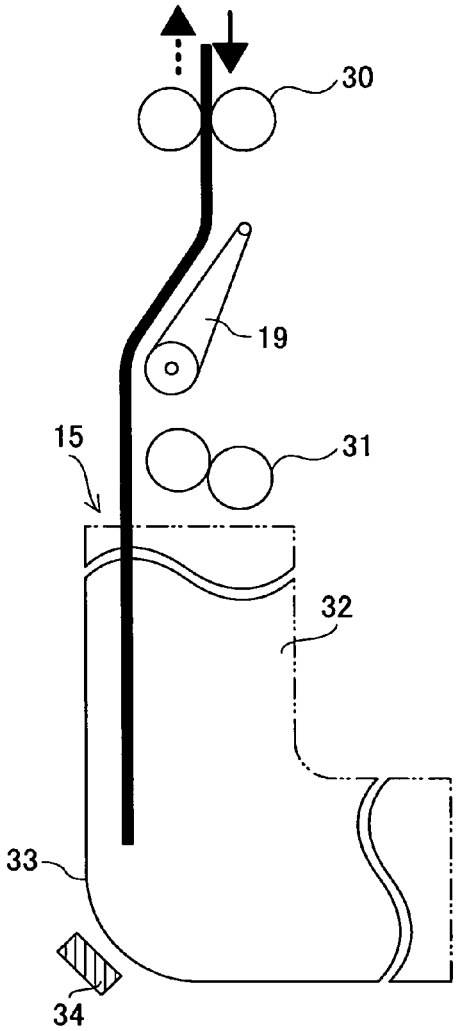
FIG. 2 shows a common open-space unit of the printing apparatus of FIG. 1 and its vicinity in a sheet reverse discharge process.
Figure 3:
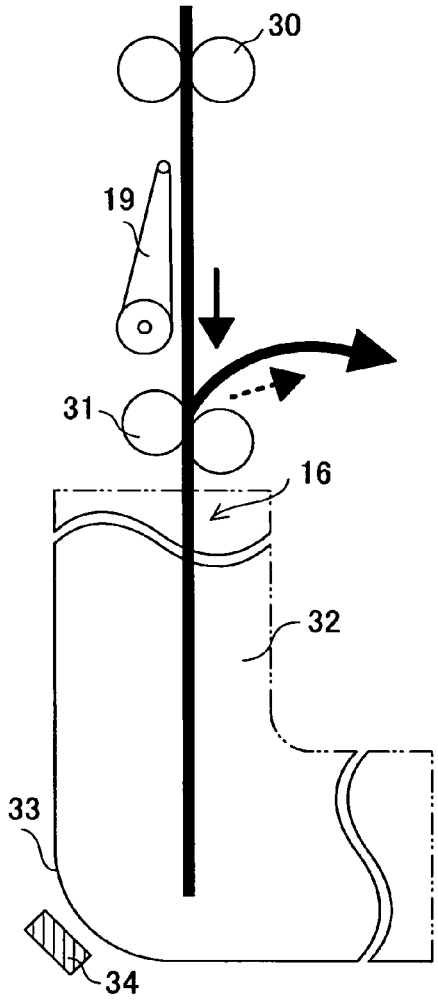
FIG. 3 shows a common open-space unit of the printing apparatus of FIG. 1 and its vicinity in a double-side reversing process.
Figure 4:
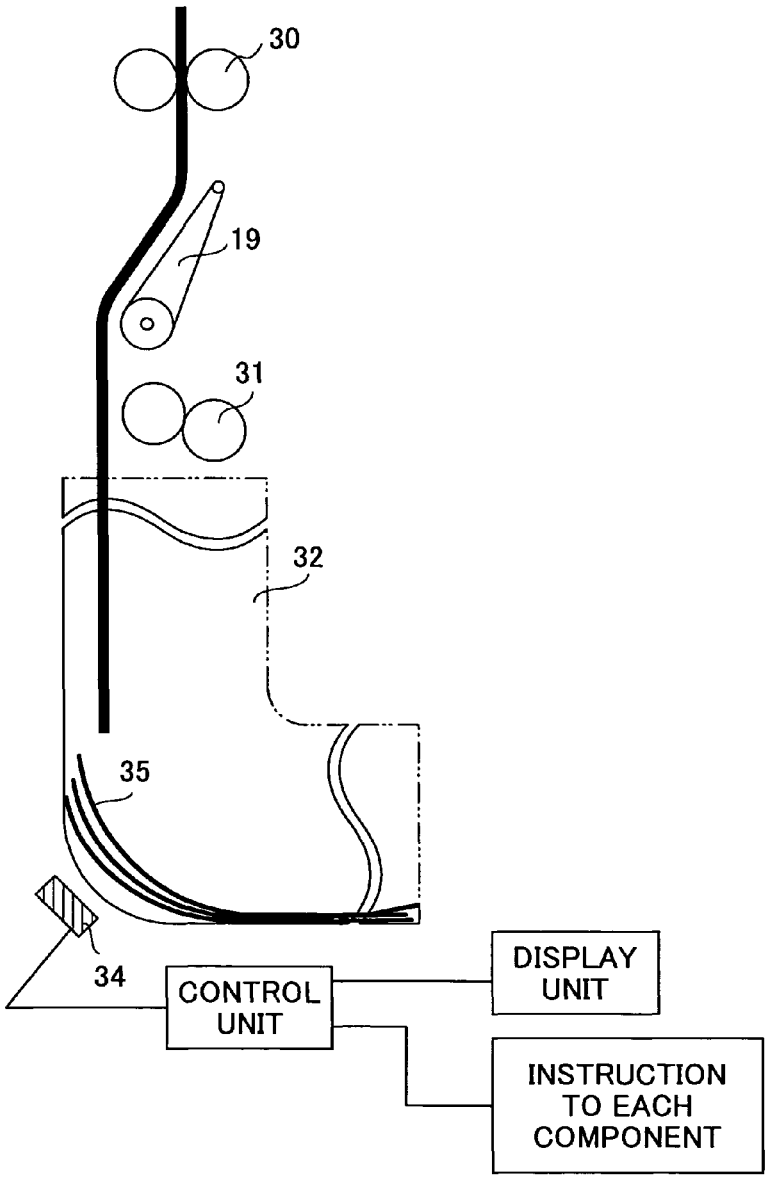
FIG. 4 shows a condition in which remaining recording media left inside the printing apparatus of FIG. 1 when jamming has occurred in the printing apparatus are collected in the common open-space unit.

The following describes operations of main components according to the embodiments of the present invention with the aid of FIGS. 2-4 showing enlarged views of the common open-space unit 32 in FIG. 1 and its vicinity. In FIGS. 2-4, the common open-space unit 32 is shown by a chain double-dashed line while the guide member 33 is shown by a solid line, and the vertical and horizontal parts of the L-shaped common open-space unit 32 are partly omitted from the illustrations.

FIG. 2 explains operations of respective components in the sheet reverse discharge process. In FIG. 2, a bold solid line represents a recording medium in the sheet reverse discharge process, and the solid arrow indicates the direction in which the recording medium enters the reverse discharge conveyance path after being deflected by the branching unit 18 (see FIG. 1). The recording medium moving through the reverse discharge conveyance path after being deflected by the branching unit 18 is, by a main body control unit (not shown) of the printing apparatus 100, routed through the reverse discharge rollers 30, and deflected by the branching unit 19 to take the conveyance path toward the reverse discharge open-space unit 15. After the recording medium is guided to the common open-space unit 32, which partly consists of the reverse discharge open-space unit 15, the conveyance is stopped when the rear end of the recording medium as viewed in the direction of conveyance (i.e. direction indicated by the solid arrow in FIG. 2) reaches a suitable position allowing the recording medium to be switched back, and then the recording medium is held in the reverse discharge open-space unit 15, namely, in the common open-space unit 32. Subsequently, the reverse discharge rollers 30 are rotated in the direction opposite from the previous conveyance direction by the main body control unit, thereby sending the recording medium out in the direction indicated by the dotted arrow in FIG. 2. Consequently, the recording medium reversed in the image forming apparatus is discharged outside the image forming apparatus in the direction of arrow C in FIG. 1 as described above, and then sent to a sheet discharged tray or a post-processing apparatus (not shown).

FIG. 3 explains operations of respective components in the double-side reversing process. As in the sheet reverse discharge process described in FIG. 2, a recording medium in the double-side reversing process is also deflected by the branching unit 18 in the direction toward the reverse discharge conveyance path. The recording medium after being deflected by the branching unit 18 is sent out to the double-side reversing conveyance path by the branching unit 19, as shown by the solid arrow in FIG. 3. Then, the recording medium is held between the double-side reversing rollers 31 and guided to the common open-space unit 32, which partly consists of the double-side reversing open-space unit 16 provided on the double-side reversing conveyance path. The conveyance is stopped when the rear end of the recording medium reaches a suitable position allowing the recording medium to be switched back, and then the recording medium is held in the double-side reversing open-space unit 16, namely, in the common open-space unit 32. Subsequently, the double-side reversing rollers 31 rotate in the opposite direction from the previous conveyance direction to send the recording medium in the direction of the dotted arrow in FIG. 3 to the sheet resending conveyance path 17.

FIG. 4 shows a condition in which, when jamming or another kind of conveyance failure has been detected in the printing apparatus 100 by a publicly known jam detection unit (not shown), the remaining recording media 35 left inside the printing apparatus 100 are collected in the common open-space unit 32. When a conveyance failure occurs, the main body control unit causes the branching unit 19 to be set to open up and maintain the sheet reverse discharge process conveyance path 15. In such a situation, the main body control unit drives the main conveyance path, reverse discharge conveyance path and double-side reversing conveyance path while preventing the reverse discharge rollers 30 from being driven in reverse for switchback, whereby misfed recording media and remaining recording media 35 left inside the printing apparatus 100 are collected in the common open-space unit 32 which serves as a temporary tray.

To collect, in the common open-space unit 32 functioning as a temporary tray, the remaining recording media 35 left inside the printing apparatus 100 at the occurrence of a jam, the main body control unit controls the branching unit 19 to make the reverse discharge conveyance path available for use, as described above. The purpose of this control is to convey to the common open-space unit 32 a remaining recording medium left at the double-side reversing rollers 31 when a jam has occurred during the double-sided image forming process.

FIGS. 2-4 depict that a detection unit 34 for detecting the presence of the remaining recording media 35 is disposed close to the curvature of the common open-space unit 32. When detecting the presence of the remaining recording media 35, the detection unit 34 informs the main body control unit accordingly. The main body control unit causes the display unit 22 on the top face of the printing apparatus 100 to display information indicating the presence of the remaining recording media 35 so as not to allow a next image forming operation to be started. This procedure is designed to avoid further jamming by a recording medium of the next new image forming operation striking the remaining recording media 35 if the image forming apparatus is started running to carry out the sheet reverse discharge process or the double-sided image forming process while the remaining recording media 35 are still in the common open-space unit 32. A reflective optical sensor or a transmissive optical sensor, for example, can be used as the detection unit 34; however, the embodiment of the present invention is not limited to them. General use, publicly-known detection means may be used, provided the detection means is able to detect the recording media 35 remaining in the common open-space unit 32. In addition, there are many possible arrangements and dispositions for the installation of the detection means.

The present embodiment illustrates an example of an image forming apparatus having not only a double-sided reversing conveyance path but also a reverse discharge conveyance path; however, the present invention is not limited to the embodiment. As is obvious to one skilled in the art, publicly-known image forming apparatuses having no reverse discharge conveyance path and performing a sheet reverse discharge process using only a main conveyance path are also within the scope of the present invention. Such image forming apparatuses include, for example, an apparatus that keeps conveying in the vertical direction a recording medium sent out from the paper feeding unit 14 (shown in FIG. 1) in the vertical direction and discharges the recording medium on the top face of the apparatus in a face down orientation. This apparatus transfers images to the recording medium while being conveyed in the vertical direction, unlike the embodiments of the present invention in which images are transferred to a recording medium at the lower part of the photosensitive drums 2. Such a kind of apparatus does not require a reverse discharge conveyance path for switching back a recording medium in order to reverse the sides of the recording medium. As a result, the above-mentioned common open-space unit 32 is formed as a double-side reversing open-space unit, and a path branched off from the main conveyance path by a branching unit is formed of only a double-side reversing conveyance path.

In the case where monochrome printing is performed by a full color printing image forming apparatus, like the printing apparatus 100 of the present embodiment, the image forming apparatus forms a toner image simply using the image forming unit 1K of black (K) only and transfers the toner image to transfer paper via the intermediate transfer belt 8. The recording medium with the fixed toner image is handled in the same manner as in the above-described full color printing.

The image forming apparatus according to the embodiments of the present invention employs arbitrary image forming methods. In the case of color image forming apparatuses, systems that may be adopted include a tandem type direct transfer system; a system having multiple developers around a single image carrier; and a system using a rotary developer. Note that the present invention is not limited to full color image forming apparatuses, and is also applicable to monochrome image forming apparatuses. The present invention can adopt suitable structures for respective components of the image forming apparatus, such as a toner fixing device and an optical writing device. Furthermore, the image forming process is not limited to electrophotography, and may employ an inkjet process or any arbitrary image forming process. Moreover, the present invention is also applicable to so-called multifunction peripherals further including a facsimile function and the like.

One embodiment of the present invention is applicable to an image forming apparatus capable of conducting double-sided image formation. According to the embodiment of the present invention, the double-side reversing open-space unit—which is configured to provide a space for switching back a recording medium on the double-side reversing conveyance path—also serves as a temporary tray for collecting misfed recording media and remaining recording media left inside the image forming apparatus when a jam occurs. Herewith, compared to an image forming apparatus having separately a dedicated open-space unit for switching back a recording medium and a dedicated temporary tray, the image forming apparatus according to the embodiment of the present invention allows its size to be decreased. Furthermore, the image forming apparatus according to the embodiment of the present invention prevents cost increases due to an increase in the number of parts required, and also facilitates and simplifies the recovery operation for jamming. Thus, the embodiment of the present invention realizes an image forming apparatus which requires a minimum installation area while improving its operational productivity due to shortening of the time required for the jam recovery operation.

According to another embodiment of the present invention, the double-side reversing open-space unit has a generally L-shaped outline and includes a guide member curved to follow the L-shaped outline. Herewith, the embodiment of the present invention allows reducing the size of the double-side reversing open-space unit both in the vertical and horizontal directions, leading to a further reduction in size of the image forming apparatus.

According to yet another embodiment of the present invention, a detection unit for detecting the presence and absence of a recording medium in the double-side reversing open-space unit is disposed in or in the vicinity of the double-side reversing open-space unit, and in the case where the detection unit detects the presence of the recording medium in the double-side reversing open-space unit, control is performed to cause the operations display unit to provide a display indicating the presence of the recording medium in the double-side reversing open-space unit and prevent the next image forming process from being executed. Herewith, the embodiment of the present invention is able to facilitate an operation of removing recording media collected in the double-side reversing open-space unit serving as a temporary tray. This structure allows preventing the occurrence of further jamming which might be otherwise caused by a recording medium of the next new image forming operation striking against the recording media collected in the double-side reversing open-space unit.

One embodiment of the present invention is applicable to an image forming apparatus capable of conducting double-sided image formation and also having a reverse discharge conveyance path configured to reverse discharge a recording medium, one side of which has an image formed. According to the embodiment of the present invention, the reverse discharge open-space unit and the double-side reversing open-space unit are disposed one adjacent to the other to together form a common open-space unit, which also serves as a temporary tray for collecting misfed recording media and remaining recording media left inside the image forming apparatus when a jam occurs. Herewith, compared to an image forming apparatus having a reverse discharge conveyance path and a double-side reversing conveyance path individually established in addition to a dedicated temporary tray, the image forming apparatus according to the embodiment of the present invention allows its size to be decreased. Furthermore, the image forming apparatus according to the embodiment of the present invention prevents cost increases due to an increase in the number of parts required, and also facilitates and simplifies the recovery operation for jamming. Thus, the embodiment of the present invention realizes an image forming apparatus which requires a minimum installation area while improving its operational productivity due to shortening of the time required for the jam recovery operation.

According to one embodiment of the present invention, the reverse discharge conveyance path, the double-side reversing conveyance path, the branching unit and the common open-space unit are arranged in a vertical direction. This arrangement further prevents the expansion of the width of the image forming apparatus, leading to a further reduction in the installation area of the image forming apparatus.

According to one embodiment of the present invention, the common open-space unit has a generally L-shaped outline and includes a guide member curved to follow the L-shaped outline. Herewith, the embodiment of the present invention allows reducing the size of the common open-space unit both in the vertical and horizontal directions, leading to a further reduction in size of the image forming apparatus.

According to one embodiment of the present invention, a detection unit for detecting the presence and absence of a recording medium in the common open-space unit is disposed in or in the vicinity of the common open-space unit, and in the case where the detection unit detects the presence of the recording medium in the common open-space unit, control is performed to cause the operations display unit to provide a display indicating the presence of the recording medium in the common open-space unit and prevent the next image forming process from being executed. Herewith, the embodiment of the present invention is able to facilitate an operation of removing recording media collected in the common open-space unit serving as a temporary tray. This structure allows preventing the occurrence of further jamming which might be otherwise caused by a recording medium of the next new image forming operation striking against the recording media collected in the common open-space unit.

This application is based on Japanese Patent Application serial No. 2007-217207 filed in Japan Patent Office on Aug. 23, 2007, the contents of which are hereby incorporated herein by reference.

What is claimed is:

1. An image forming apparatus, comprising:

a main conveyance path configured to convey a recording medium;

a double-side reversing conveyance path configured to switch back the recording medium, one side of which has an image formed thereon, so as to reverse sides of the recording medium for double-sided image formation;

a sheet resending conveyance path configured to resend the recording medium reversed in the double-side reversing conveyance path to the main conveyance path;

a double-side reversing open-space unit configured to provide a space for switching back the recording medium on the double-side reversing conveyance path, and configured to serve as a temporary tray;

a double-side reversing roller configured to convey the recording medium to the double-side open-space unit by rotating in a forward direction and resend the recording medium into the sheet resending conveyance path by rotating in a backward direction, the backward direction being opposite to the forward direction;

a detection unit disposed at a position downstream of the double-side reversing roller in the forward direction or in a vicinity of the double-side reversing open-space unit and configured to detect presence and absence of a recording medium remaining inside the image forming apparatus stored in the temporary tray for storing therein the recording medium remaining inside the image forming apparatus when a jam occurs; and an operations display unit configured to provide a display thereon, wherein in a case where the detection unit detects the presence of the recording medium, control is performed to cause the operations display unit to provide a display indicating the presence and prevent a next image forming process from being executed.

2. The image forming apparatus of claim 1, wherein the double-side reversing open-space unit has a generally L-shaped outline and includes a guide member curved to follow the L-shaped outline.

3. An image forming apparatus, comprising:

a main conveyance path configured to convey a recording medium;

a double-side reversing conveyance path configured to switch back the recording medium, one side of which has an image formed thereon, so as to reverse sides of the recording medium for double-sided image formation;

a sheet resending conveyance path configured to resend the recording medium reversed in the double-side reversing conveyance path to the main conveyance path;

a double-side reversing open-space unit configured to provide a space for switching back the recording medium on the double-side reversing conveyance path;

a reverse discharge conveyance path configured to switch back the recording medium, one side of which recording medium has an image formed thereon, so as to reverse sides of the recording medium and thereby reverse discharge the recording medium;

a reverse discharge open-space unit configured to provide a space for switching back the recording medium on the reverse discharge conveyance path; and a branching unit configured to switch a recording-medium conveyance path between the sheet reverse discharge conveyance path and the double-side reversing conveyance path, wherein the double-side reversing open-space unit also serves as a temporary tray for storing therein a misfed recording medium and a recording medium remaining inside the image forming apparatus when a jam occurs, and wherein the reverse discharge open-space unit and the double-side reversing open-space unit are disposed one adjacent to the other to together form a common open-space unit, which also serves as the temporary tray.

4. The image forming apparatus of claim 3, wherein the reverse discharge conveyance path, the double-side reversing conveyance path, the branching unit and the common open-space unit are arranged in a vertical direction.

5. The image forming apparatus of claim 4, wherein the common open-space unit has a generally L-shaped outline and includes a guide member curved to follow the L-shaped outline.

6. The image forming apparatus of claim 5, further comprising:

a detection unit disposed in or in the vicinity of the common open-space unit and configured to detect presence and absence of a recording medium in the common open-space unit; and an operations display unit configured to provide a display thereon, wherein in a case where the detection unit detects the presence, control is performed to cause the operations display unit to provide a display indicating the presence and prevent a next image forming process from being executed.

7. The image forming apparatus of claim 4, further comprising:

a detection unit disposed in or in the vicinity of the common open-space unit and configured to detect presence and absence of a recording medium in the common open-space unit; and an operations display unit configured to provide a display thereon, wherein in a case where the detection unit detects the presence, control is performed to cause the operations display unit to provide a display indicating the presence and prevent a next image forming process from being executed.

8. The image forming apparatus of claim 3, wherein the common open-space unit has a generally L-shaped outline and includes a guide member curved to follow the L-shaped outline.

9. The image forming apparatus of claim 8, further comprising:

a detection unit disposed in or in the vicinity of the common open-space unit and configured to detect presence and absence of a recording medium in the common open-space unit; and an operations display unit configured to provide a display thereon, wherein in a case where the detection unit detects the presence, control is performed to cause the operations display unit to provide a display indicating the presence and prevent a next image forming process from being executed.

10. The image forming apparatus of claim 3, further comprising:

a detection unit disposed in or in the vicinity of the common open-space unit and configured to detect presence and absence of a recording medium in the common open-space unit; and an operations display unit configured to provide a display thereon, wherein in a case where the detection unit detects the presence, control is performed to cause the operations display unit to provide a display indicating the presence and prevent a next image forming process from being executed.

* * * * *